United States Patent [19]

Okumura et al.

[11] 4,131,049

[45] Dec. 26, 1978

[54] ELECTRONIC MUSICAL INSTRUMENT HAVING MEMORIES CONTAINING WAVESHAPES OF DIFFERENT TYPE

[75] Inventors: Takatoshi Okumura; Shimaji Okamoto, both of Hamamatsu, Japan

[73] Assignee: Nippon Gakki Seizo Kabushiki Kaisha, Hamamatsu, Japan

[21] Appl. No.: 729,690

[22] Filed: Oct. 5, 1976

[30] Foreign Application Priority Data

Oct. 6, 1975 [JP] Japan ..... 50-120519

[51] Int. Cl.[2] ..... G10H 1/00

[52] U.S. Cl. ..... 84/1.01; 84/1.11

[58] Field of Search ..... 84/DIG. 5, 1.01, 1.2, 84/1.22–1.25

[56] References Cited

U.S. PATENT DOCUMENTS 3,740,450 6/1973 Deutsch ..... 84/1.23

3,854,365 12/1974 Tomisawa et al. ..... 84/1.24

*Primary Examiner*—Robert K. Schaefer

*Assistant Examiner*—Vit W. Miska

*Attorney, Agent, or Firm*—Spensley, Horn & Lubitz

[57] ABSTRACT

A plurality of waveshape memories are provided for storing the sampled values of one cycle sinusoidal wave as the fundamental frequency, two cycle sinusoidal wave as the second harmonic, . . . and m cycle sinusoidal wave as the m-th harmonic and, in addition thereto, of harmonic-abundant complex waves such as a triangular wave, a sawtooth wave and a rectangular wave. These waveshape memories are read at the same reading rate. The read out sinusoidal waves and triangular, sawtooth and rectangular waves are controlled in their relative levels in accordance with the tone-color of an intended musical tone wave shape. The sinusoidal waves and the triangular, sawtooth and rectangular waves are thereafter synthesized to produce a desired tone-color wave shape. Since the triangular, sawtooth and rectangular waves contain abundant harmonic components, many kinds of musical tones containing abundant harmonic components can be produced despite a limited number of waveform memories.

3 Claims, 2 Drawing Figures

TO AUDIO SYSTEM 10
9
BVR
VR
VR
AG
AG
AG
AG
AG
AG
AG
AG
UE
UE
UE
LE
LE
PE
PE
RG
TRIANGULAR WAVE
SAWTOOTH WAVE
RECTANGULAR WAVE
(VCF)
(VCF)
(VCF)
81
82
83
8
WM1
WM12
71
72
73
FROM SINUSOIDAL WAVE MEMORIES
FROM WAVESHAPE MEMORIES
FROM WAVESHAPE MEMORY GROUP 7

ELECTRONIC MUSICAL INSTRUMENT HAVING MEMORIES CONTAINING WAVESHAPES OF DIFFERENT TYPE

BACKGROUND OF THE INVENTION

This invention relates to an improvement in an electronic musical instrument of a type wherein multiple waveforms are read out from waveshape memories and are mixed to form a musical tone waveform of a desired tone color.

There has been proposed an electronic musical instrument in which a desired musical tone waveform is produced by reading out, from waveshape memories, sinusoidal waveforms corresponding to respective harmonic components constituting the musical tone and mixing these read out sinusoidal waveforms at suitable relative amplitude levels. If a musical tone containing a large number of harmonic components is to be obtained in this type of instrument, the same number of memories as the number of harmonic components must be provided. This requires a large number of memories resulting in a high manufacturing cost. Besides, since the respective memories are accessed by the same address signal, the number of sample points in one cycle of the sinusoidal wave decreases as the order of the harmonic increases. Accordingly, a large number of sample points is required in the case of a harmonic of a high order in order to maintain a satisfactory waveform and this requires enlarged capacity of the memory.

SUMMARY OF THE INVENTION

It is, therefore, an object of the present invention to provide an electronic musical instrument capable of producing musical tones of various tone colors containing a large number of harmonics with a very simple construction. The electronic musical instrument according to the invention comprises waveform memories of a limited number of n respectively storing sinusoidal waves corresponding to n harmonics (i.e. first, second, third, . . . n-th) and also some other memories storing waveforms containing abundant harmonic components such as a rectangular wave, a triangular wave and a sawtooth wave. A desired musical tone is produced by reading these waveforms from the respective memories by means of the same address signal and then suitably mixing the read out waveforms at desired relative amplitude levels. By this arrangement, the number of harmonics obtained is much larger than the number of memories used.

A preferred embodiment of the invention will now be described with reference to the accompanying drawings.

DESCRIPTION OF THE PREFERRED EMBODIMENTS

Figure 1:
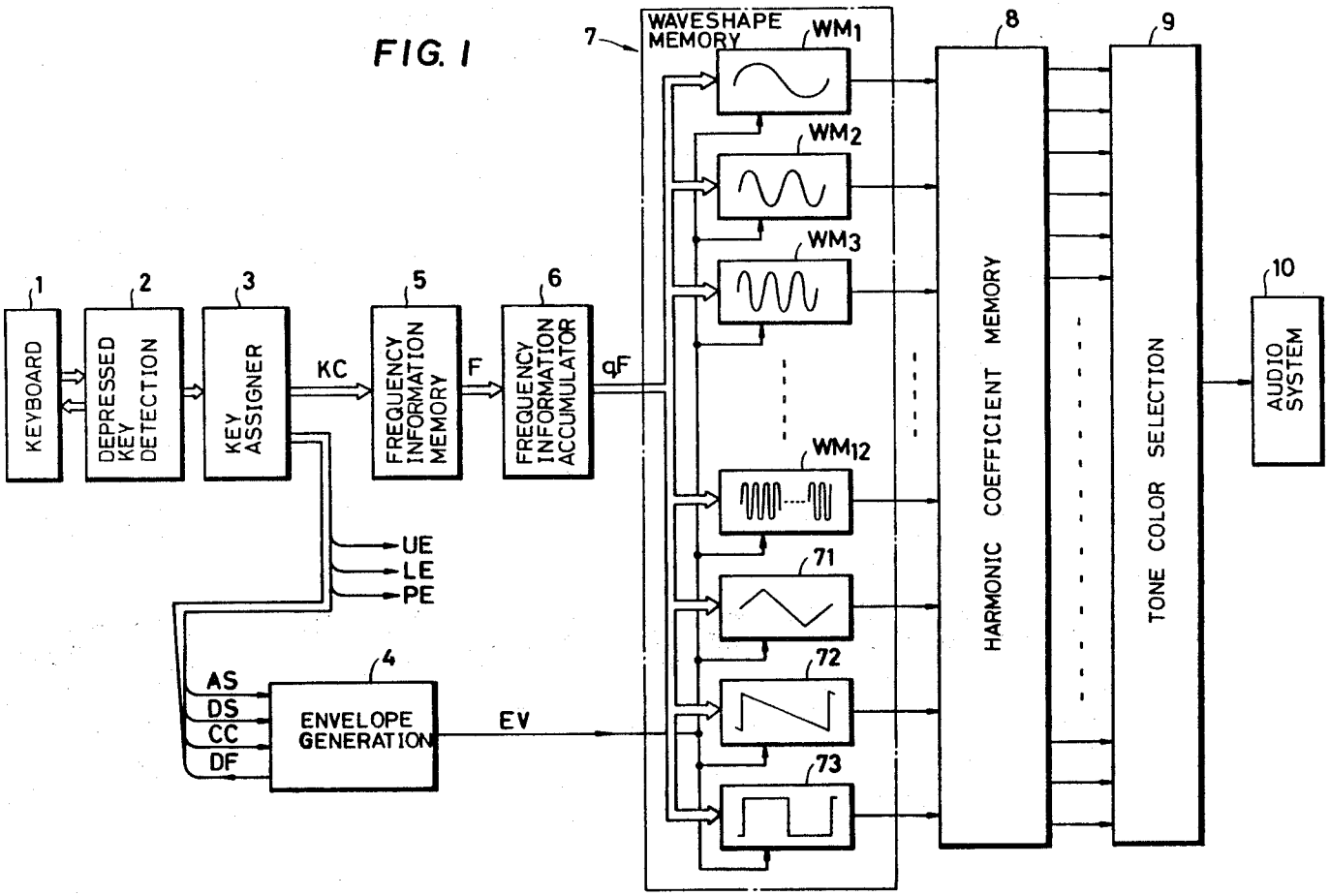
FIG. 1 is a block diagram of one embodiment of the present invention.

Referring to FIG. 1, a depressed key detection or detector circuit 2 detects the on or off actuation of the respective key switches corresponding to the keys disposed at the keyboards 1 and thereby produces information for identifying the depressed key or keys. The key assigner circuit 3 receives the information for identifying the keys thus depressed from the depressed key detection circuit 2 and assigns production of the tones of the key or keys indicated by the information to vacant ones of the channels prepared in a number which defines a maximum number of musical tones to be simultaneously produced (e.g., 12 channels as in the present embodiment). The key assigner circuit 3 comprises storing positions corresponding to the respective channels for storing key codes KC representative of the keys at the storing positions corresponding to the channels to which the production of tones of the keys are assigned and successively outputs the key codes KC stored at the respective channels in a time-sharing manner. Accordingly, in case a plurality of keys are simultaneously depressed in the keyboards 1, the tones of the depressed keys are separately assigned to the respective channels in such a manner that the key codes KC indicative of the assigned tone of the depressed keys are stored at the storing positions defining the respective channels. The respective storing positions may preferably consist of respective stages of a circulating shift register.

The key assigner circuit 3 also delivers out upon depression of the key an attack start signal or key-on signal AS representing that the musical tone should be produced at the channel to which the tone of the key is assigned. The key code KC and the attack start signal AS are delivered in synchronization with the assigned channel time. The key assigner circuit 3 further delivers out upon release of the depressed key a decay start signal or key-off signal DS indicating that the musical tone should decay at the channel to which the tones of the key is assigned. The decay start signal DS is delivered also in synchronization with the respective channel time. These signals AS and DS will be utilized in an envelope generation or generator circuit 4 for controlling the amplitude of the envelope of the musical tones i.e. controlling the tone production. The key assigner circuit 3 receives from the envelope generation circuit 4 a decay finish signal DF representing that the tone production at the corresponding channel is finished and thereupon produces a clear signal CC for clearing the various information stored in the shift registers at the stages defining the channels based on the decay finish signal DF so as to completely eliminate the tone production assignment. The key assigner circuit 3 also produces the keyboard signals UE, LE and PE indicating which keyboard the depressed key belongs to in synchronization with the outputs of the key codes KC. The identification of the key code KC in relation to the kind of the keyboard can be made by the bits $K_2$ and $K_1$ of the code indicating the kind of keyboard.

The aforementioned key assigner circuit 3 and the depressed key detection circuit 2 will now further be described in detail. These circuits 2 and 3 may be a depressed key detection circuit and a key assigner, respectively of the types disclosed in U.S. Pat. No. 3,882,751 entitled "Electronic musical instrument" issued and assigned to the same assignee as in the present invention. These circuits 2 and 3 may also be constructed by the circuit arrangements other than the arrangements disclosed as described above within the spirit and scope of the present invention, but they will not be described in any greater detail.

It is to be noted that since the key codes KC delivered out from the key assigner circuit 3 represent the depressed keys, these key codes KC are utilized as address designation signals for reading out from a frequency information memory 5 a numerical information specific to the frequencies of the musical tones of the keys represented by the key codes KC.

The frequency information memory 5 is constructed by, for example, a read-only memory (ROM) for storing the frequency information F (constants) corresponding to the key codes KC of the respective keys, which read-only memory serves the functions of delivering out the frequency information F stored at the address designated by the code upon receipt of a certain key code DC. The frequency information memory 5 is not limited only to this type of ROM but may also adopt other than this within the spirit and scope of the present invention. A frequency information accumulator 6 regularly makes an cumulative addition of the frequency information F to develop successively increasing address signals for accessing memorized amplitude samples of the musical tone waveform at every predetermined constant time. Accordingly, the frequency information F are of digital numbers respectively proportional to the respective frequencies of the musical tones, such as, for example, binary numbers of 15 bits as disclosed in the specification of U.S. Pat. No. 3,882,751 entitled "Electronic musical instrument" assigned to the same assignee as in the present invention. This frequency information F for each frequency consists of a suitable number of bits, e.g. 15 as in the present embodiment, and represents numerals including fraction section if expressed in a decimal notation. The most significant bit of the 15 bits indicates an integer section and the rest of the bits, i.e., 14, represents a fraction section.

The value of the frequency information F may be unitarily determined by a certain constant sampling speed if the value of the frequency of the musical tone is specified. For example, assume that when the value qF cumulatively added with the information F by the frequency information accumulator 6 becomes 64 in a decimal notation, the sampling of the one musical tone waveform is completed (where $q = 1, 2, \ldots$) and also that this cumulative addition is achieved every 12 $\mu$s when the entire channel times are cyclically circulated once. The value of the frequency information F can be determined in accordance with the following equation:

$$F = 12 \times 64 \times f \times 10^{-6}$$

where $f$ signifies the frequencies of the musical tones. It will be understood that the frequency information F is stored in the frequency information memory 5 in accordance with the frequency $f$ to be obtained.

The frequency information accumulator 6 serves the functions of cumulatively adding the frequency information F of the respective channels at a predetermined constant sampling speed, e.g., at 12 $\mu$s per respective channel times in the present embodiment for obtaining the accumulated value $q$F so as to advance the phase of the musical tone waveform to be read out at every sampling time (12 $\mu$s). When the accumulated value $q$F reaches 64 (exceeds 63) in a decimal notation, the frequency information accumulator 6 overflows to return to zero to thus complete the reading of one waveform. Since 63 in a decimal notation can be represented by 6-bit binary number, the frequency information accumulator 6 is so constructed by a counter or accumulator of 20 bits in one word wherein the first to fourteenth bits represent the fraction section and fifteenth to twentieth bits represent the integer section as to keep the accumulated result until the accumulated value qF of the frequency information F whose fifteenth bit is the unit digit of the integer section becomes 64. It should be noted that the frequency information accumulator 6 is constructed by 12 stage/20-bit shift register together with a 20-bit adder commonly used for the respective channels in a time-sharing manner. The data of the most significant 6 bits constituting the integer section among the output qF of the frequency information accumulator 6 is applied to a waveshape different sinusoidal waveshapes corresponding to 12 harmonic frequencies. For example, harmonics of the first (fundamental), second, third, fourth, fifth, sixth, seventh, eighth, tenth, twelfth, fourteenth, and sixteenth orders are stored in the waveshape memories $WM_1$–$WM_{12}$, one harmonic in one memory. These waveshape memories $WM_1$–$WM_{12}$, 71, 72 and 73 are constructed in such a manner that waveshape amplitude values at sample points corresponding to the digital address signals are read out in analog quantity, and may adopt, for example, the memories of the construction as disclosed in the specification of U.S. Pat. No. 3,890,602 entitled "Waveform Producing Device" assigned to the same assignee as the present invention. More particularly, the waveshape memories may be constructed so that amplitude value voltages at respective sample points of a waveshape are read out as desired by switching operation of electronic switching elements. Needless to say, the respective memories $WM_1$–$WM_{12}$, 71–73 may be constructed with read-only memories of a digital type whereby the waveshape amplitude values at sample points are read out in digital notation and the digital values thus obtained are thereafter converted into analog values by a digital-to-analog converter.

If the output of the frequency information accumulator 6 to the memory group 7 as address input is information of 6 bits, 64 different address signals can be produced and, accordingly, the number of sample points in each of the memories $WM_1$–$WM_{12}$, 71–73 is 64. Since the contents of the respective memories $WM_1$–$WM_{12}$, 71–73 are read out simultaneously by means of the same address signal, the number of waveshape stored in the sinusoidal waveshape memories $WM_1$–$WM_{12}$ is not necessarily one (1 cycle) but a number equal to the order of the harmonic. For example, the memory $WM_1$ stores one cycle of sinusoidal waveshape at 64 sample points and the memory $WM_{12}$ stores 16 cycles of sinusoidal waves at 64 sample points.

Accordingly, even though only one kind of output is produced from the frequency information accumulator 6, the waveshape memory group 7 produces 12 different kinds of sinusoidal wave signals each being in harmonic relation to each other in frequencies and a triangular wave signal, a sawtooth wave signal and a rectangular wave signal each having a number of higher harmonic components of specific frequency spectrum, respectively. Alternatively stated, a plurality of waveshapes (including sinusoidal waves) are produced in parallel. Since these elementary waveshapes are of the same level, a harmonic coefficient memory circuit 8 is provided for adjusting the mixing levels of sinusoidal waves corresponding to the respective harmonic frequencies and triangular, sawtooth and rectangular waves, and thereby synthesizing a desired tone color.

Figure 2:
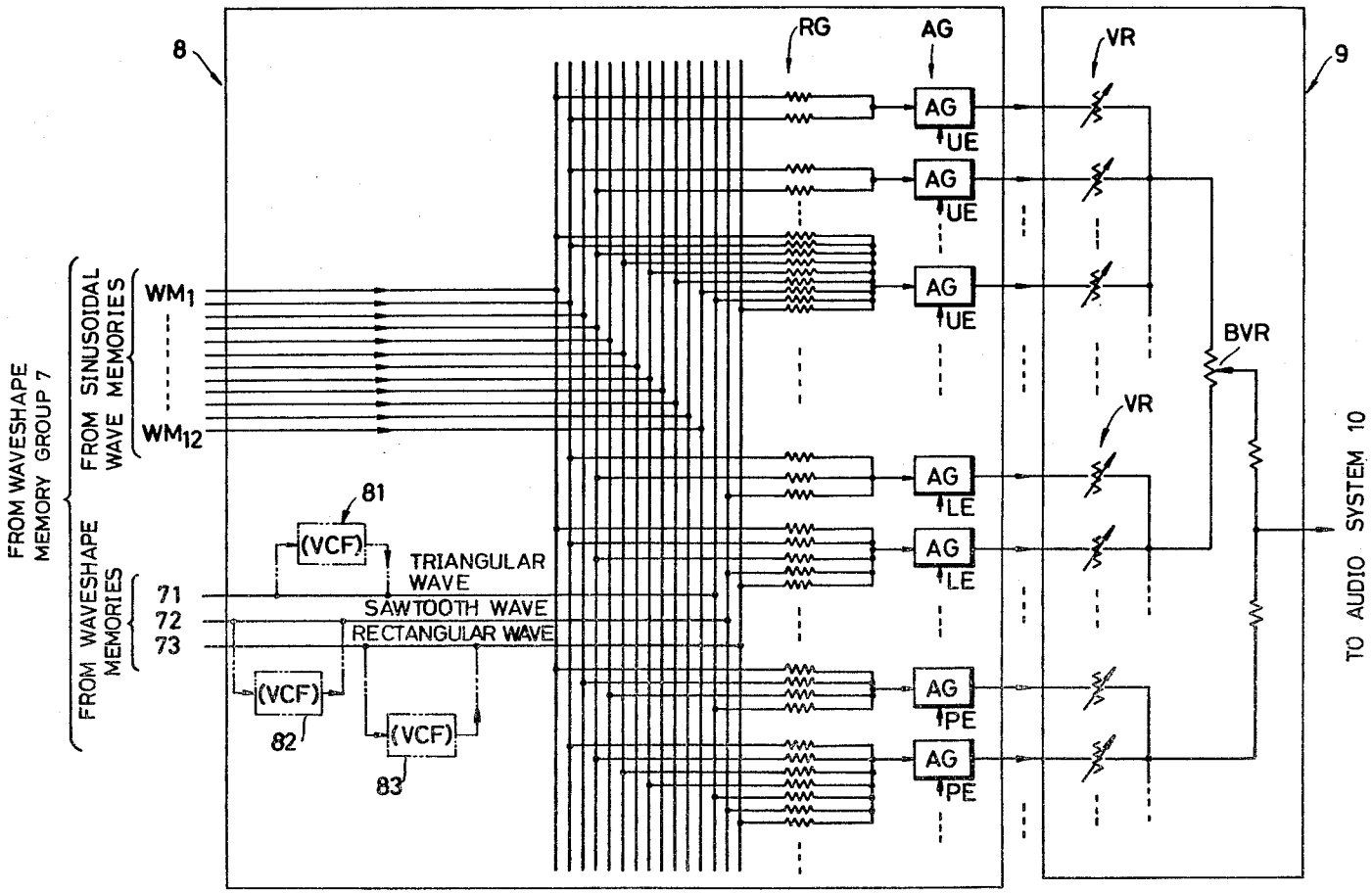
FIG. 2 is a schematic circuit diagram of one example of the harmonic coefficient memory circuit in the embodiment of the present invention.

A harmonic coefficient memory circuit 8 shown in FIG. 2 consists of a mixing resistor network and analog gate circuits. The sinusoidal wave signals, of the twelve kinds of harmonic frequencies, and triangular, sawtooth and rectangular wave signals supplied from each of the waveshape memory group 7 are resistance-mixed by a resistor group RG at combinations and levels required for producing desired tone colors. Resistor elements composing the resistor groups RG have resistance values determining relative amplitude levels among elementary frequencies provided by the waveshape memories $WM_1$–$WM_{12}$, 71–73. The harmonic waves (sinusoidal waves) having frequencies of respective harmonic orders required for producing a signal of a desired tone color are supplied to the resistor elements and, in order to add further harmonic wave components, predetermined harmonic-abundant waves (such as a triangular, sawtooth and rectangular waves) are supplied to the resistor elements setting relative amplitude levels of the required harmonic components and are thereafter applied respectively to an analog gate circuit AG. Accordingly, a mixing resistor network is made up of the resistor group RG with respect to each of tones to be produced by this electronic musical instrument and the output of the mixing resistor network is applied to the analog gate circuits AG. The combinations of these mixing resistor net work and analog gate circuits are formed for each of the keyboards so that tone color control can be made keyboard by keyboard.

The upper keyboard signal UE, lower keyboard signal LE and pedal keyboard signal PE delivered from the key assigner circuit 3 are respectively applied to the gate control input terminals of the gate circuits AG for the corresponding keyboards to enable these gate circuits AG. Since the key codes KC are produced in complete synchronization with the signals UE-PE, a keyboard to which a key corresponding to signals read from the waveshape memory group 7 during a certain channel time belongs coincides with a keyboard represented by either one of the signals UE, LE and PE which enables the gate circuits AG during that time. Accordingly, all the musical tone waveshape of tone colors available for production in a keyboard to which the key being depressed belongs are simultaneously produced from the harmonic coefficient memory circuits 8. At that time no tone colors of the other keyboards are produced.

The tone color signals outputted from the harmonic coeffi cient memory circuit 8 are supplied respectively to a tone color selector 9. The tone color selector 9 selectively mixes the tone colors by operation of the variable resistor elements VR to provide the tone colors available for production in each of the keyboards. Accordingly, the variable resistor elements VR are provided in correspondence to the respective outputs (tone color outputs) of the harmonic coefficient memory circuit 8. The outputs of the variable resistor elements VR are first combined keyboard by keyboard. The outputs of the upper keyboard and the lower keyboard are balance controlled in volume by a balance control variable resistor BVR and thereafter are mixed with the output of the pedal keyboard. This mixed output constitutes an output musical tone signal of the tone color selector 9 which will be produced as audible sound through an audio system 10.

In the harmonic coefficient memory circuit 8, the outputs such as triangular, sawtooth and rectangular waves of the tone waveshape memories 71, 72 and 73 including the harmonic wave components themselves may be introduced, to the resistor element group RG for setting the coefficient, through suitable filters (such as, for example, voltage-controlled filters VCF). Thus, specific harmonic wave components which can not be obtained from the sinusoidal memories $WM_1$–$WM_{12}$ may be produced from the triangular, sawtooth and rectangular wave signals and thereby utilized for the production of tone color (or musical tone).

In the aforementioned embodiment, in addition to the sinusoidal wave signals corresponding to the respective harmonic waves, the triangular, sawtooth and rectangular wave signals containing a number of harmonic components are also mixed with the component waveshapes of one musical tone with the result that the number of the harmonic wave components forming the musical tones may substantially be increased.

An envelope generation circuit 4 is a conventional circuit as disclosed in the specification of U.S. Pat. No. 3882751 entitled "Electronic musical instrument," and produces an envelope shape EV for controlling the amplitude envelope of the musical tones. When the attack start signal AS is applied from the key assigner circuit 3 thereto, it produces the envelope of the attack portion and then produces a sustain level of constant level, and when the decay start signal DS is applied from the key assigner circuit 3 thereto, it produces the envelope of the decay portion to attenuate the amplitude. The sequential envelope shape EV varying timingly consisting of the attack, sustain and decay portions are generated in time-shared manner with respect to each of the channels. The envelope waveshape signal EV expressed in analog form in supplied to the respective waveshape memories $WM_1$–$WM_{12}$, 71–73 of the waveshape memory group 7 and is used as power source voltage in the circuit for generating waveshape sample point amplitude voltages for the memories $WM_1$–$WM_{12}$ 71–73. Accordingly, the power source voltage in the circuit for generating the waveshape sample point amplitude voltages in each of the memories $WM_1$–$WM_{12}$, 71–73 changes in accordance with changes in the level of the envelope waveshape with a resultant change in the sample point amplitude voltage of the musical tone waveshape read from each of the memories $WM_1$–$WM_{12}$, 71–73. If, for example, no envelope shape EV is read from the envelope generation circuit 4, the power source voltage at the waveshape memories $WM_1$–$WM_{12}$, 71–73 is zero so that no musical tone waveshape is read out. In the above described manner, waveshape amplitude values are read from the memories $WM_1$–$WM_{12}$, 71–73 at levels corresponding to the envelope whereby the envelope control of the musical tone waveshape is performed.

The number of the sinusoidal wave memories $WM_1$–$WM_{12}$ (the number of the harmonic waves) and the waveshape stored in the memories 71–73 of the tone source waveshape containing a number of harmonic wave components may not always be limited to the above but may also be determined as desired. For example, since the triangular wave, sawtooth wave and rectangular wave as the tone source waveshapes has a number of harmonic wave components, the number of the sinusoidal wave memories $WM_1$–$WM_{12}$ may actually be less than in the embodiment.

What is claimed is:

1. An electronic musical instrument for generating a musical tone, comprising:

addressing means for providing a memory address signal proportional to the phase separation between consecutive sample points of the musical tone being generated;

a plurality of sinusoidal waveshape memories respectively storing individual sinusoidal waveshapes each corresponding to a specific number of harmonic components and being read by said memory address signal from said addressing means;

at least one complex waveshape memory each storing a complex waveshape containing abundant harmonic components and each being read by said memory address signal from said addressing means; and a circuit for suitably mixing the respective waveshapes read from said sinusoidal waveshape memories and said at least one complex waveshape memory for producing said musical tone, said circuit including scaling networks for individually scaling the outputs of each of said sinusoidal and complex waveshape memories so as to produce a desired tone color.

2. An electronic musical instrument according to claim 1 wherein at least one of said complex waveshape memories contains a waveshape selected from the group consisting of a triangular wave, a sawtooth wave and a rectangular wave, and wherein said scaling networks each comprise a resistor network.

3. An electronic musical instrument according to claim 2 further comprising a voltage controlled filter provided in series with the respective output of each complex waveshape memory.

* * * * *